United States Patent [19]

Yuyama et al.

[11] Patent Number: 4,950,638

[45] Date of Patent: Aug. 21, 1990

[54] THERMOSENSITIVE RECORDING MATERIAL HAVING RECORDING LAYER CONTAINING FLUORESCENT DYE COMPOSITION

[75] Inventors: Yukihiro Yuyama; Kenji Uematsu; Hiroaki Okuda; Hideo Aihara, all of Numazu, Japan

[73] Assignee: Ricoh Company, Ltd., Tokyo, Japan

[21] Appl. No.: 105,189

[22] Filed: Oct. 6, 1987

[30] Foreign Application Priority Data

| | | | |
|---|---|---|---|
| Oct. 9, 1986 | [JP] | Japan | 61-155378 |
| Dec. 10, 1986 | [JP] | Japan | 61-190276 |
| Dec. 10, 1986 | [JP] | Japan | 61-190277 |
| May 14, 1987 | [JP] | Japan | 62-072531 |

[51] Int. Cl.[5] ..... B11M 5/18

[52] U.S. Cl. ..... 503/226; 427/152; 428/690; 428/913; 503/204

[58] Field of Search ..... 427/150–152; 428/690, 913, 914; 503/200, 226, 204

[56] References Cited

U.S. PATENT DOCUMENTS

| | | | |
|---|---|---|---|
| 4,370,370 | 1/1983 | Iwata et al. | 428/913 |
| 4,647,951 | 3/1987 | Yamori et al. | 503/200 |

*Primary Examiner*—Bruce H. Hess

*Attorney, Agent, or Firm*—Oblon, Spivak, McClelland, Maier & Neustadt

[57] ABSTRACT

A thermosensitive recording material is disclosed, which comprises a support, and a thermosensitive recording layer formed on one side of the support, the thermosensitive recording layer comprising (i) a thermosensitive coloring layer comprising a thermosensitive coloring system capable of producing a color upon application of heat thereto, and (ii) a colored layer comprising a colored fluorescent dye composition.

27 Claims, 5 Drawing Sheets

THERMOSENSITIVE RECORDING MATERIAL HAVING RECORDING LAYER CONTAINING FLUORESCENT DYE COMPOSITION

BACKGROUND OF THE INVENTION

The present invention relates to a thermosensitive recording material in which the recording layer contains a fluorescent dye composition.

A conventional thermosensitive recording material comprises a support, for example, a sheet of ordinary paper or synthetic paper and a thermosensitive recording layer formed on the support. Colored images are formed in the recording layer by application of heat. Thermal printers provided with a thermal print head, thermal pens and infrared application devices are generally used to print on thermosensitive recording materials.

Because of their ability to form colored images by simple application of heat, such thermosensitive recording materials are widely used, not only for copying books and documents, but also for recording output information from computers, facsimile apparatus, telex and other information transmission and measuring instruments. Furthermore, such thermosensitive recording materials are employed as railway tickets and as adhesive labels for the POS (point of sales) system in supermarkets and department stores.

As a thermosensitive recording adhesive label comprising the above-mentioned thermosensitive recording material, there is known a thermosensitive recording adhesive label comprising a support, a thermosensitive recording layer formed on the front side of the support, an adhesive layer formed on the back side of the support opposite the thermosensitive recording layer, and a disposable backing sheet which is attached to the adhesive layer and which can be peeled from the adhesive layer when the thermosensitive recording adhesive label is used.

Such a thermosensitive adhesive label can be attached to a variety of commercial products. By thermally printing, for instance, a product name, price and bar code on the label, and applying the thermally printed label to products with the backing sheet removed, customers can tell from the label the name and price of the product and other information concerning the product. The thermally printed bar codes can be read by automatic reading apparatus and the information processed by computer, so that, for instance, the sale, stock and reorder of the product can be controlled. Furthermore, the label can be used for other purposes, for instance, as a merchandising marker by which customers can readily distinguish particular products from other products, for instance, for quickly identifying specially discounted products.

To improve product recognition, conventionally, a method of printing graphics, numbers, letters and bar codes with a color ink on a white thermosensitive recording label has been employed. A method of printing such figures or bar codes on a label coated with a fluorescent ink containing a fluorescent dye or pigment has also been employed. The former method, however, has the shortcomings that printing by a color ink is time-consuming and costly and the printed portions result in the formation of dust which adheres to a thermal print head in the course of thermal printing, whereafter the thermally printed portions can become smeared with such dust. When the bar code is pre-printed on the label to overcome this problem in part, there is the disadvantage that a necessary quantity of such pre-printed bar-code labels must be stocked for each product in advance.

When such thermosensitive recording adhesive labels are employed, particularly in food packaging, they may come into contact with oils (for instance, oils contained in foods) and plasticizers (for instance, plasticizers contained in plastic wrapping film). When the developed colored images come into contact with such oils and plasticizers they are frequently discolored or become blurred. Therefore, it is required that thermally printed images be prevented from being discolored or becoming blurred even if they are brought into contact with such adverse materials.

SUMMARY OF THE INVENTION

It is therefore an object of the present invention to provide a thermosensitive recording material having a high recognition function, which can be produced without difficulty and can be easily used in practice.

Another object of the present invention is to provide a thermosensitive recording material which is useful in reproducing a bar code having improved scannability.

Still another object of the present invention is to provide a thermosensitive recording adhesive label having a high recognition function, which does not form dust which adheres to a thermal head such that the thermally printed portions on the label are not smeared.

A further object of the present invention is to provide a thermosensitive recording adhesive label having a high recognition function, which is particularly useful in food packaging and is capable of forming images which are not discolored and do not become blurred, even if the image come into contact with oils and plasticizers.

These and other objects are achieved in the present invention which provides:

A thermosensitive recording material comprising a support and a thermosensitive recording layer formed on one side of the support, the thermosensitive recording layer comprising (i) a thermosensitive coloring layer comprising a coloring system capable of producing a color upon application of heat thereto and (ii) a colored layer comprising a colored fluorescent dye composition.

More particularly, the present invention relates to a recording material having a high recognition function which is useful in labeling a product and which is provided with a layer of an adhesive on the side of the support opposite the thermosensitive recording layer. When necessary or desirable, a disposable backing sheet can be provided on the adhesive layer and peeled from the adhesive layer prior to application.

The recording material of the present invention may also include a barrier layer which may be applied over the thermosensitive recording layer or to the back of the support to protect the layer from materials which could discolor the image developed in the layer. A front barrier layer also improves thermal head life. A back barrier layer can be interposed between the support and the optional adhesive layer in order to protect further the thermosensitive recording layer from adverse materials which may discolor the images developed in the thermosensitive layer. This is desirable when the thermosensitive label is applied to a material such as a plastic foil which contains agents such as plasticizers which may cause discoloration.

BRIEF DESCRIPTION OF THE DRAWINGS

In the drawings,

FIGS. 1B-1 to 1B-3 are schematic illustrations of cross-sectional views of examples of another variation of the first embodiment of a thermosensitive recording material according to the present invention.

FIGS. 1C-1 to 1C-3 are schematic illustrations of cross-sectional views of examples of a further variation of the first embodiment of a thermosensitive recording material according to the present invention.

FIGS. 2-1 to 2-3 are schematic illustrations of cross-sectional views of examples of a second embodiment of a thermosensitive recording material according to the present invention.

FIGS. 3-1 to 3-6 are schematic illustrations of cross-sectional views of examples of a third embodiment of a thermosensitive recording material according to the present invention.

DETAILED DESCRIPTION OF THE PREFERRED EMBODIMENTS

Figures 1, 1A:
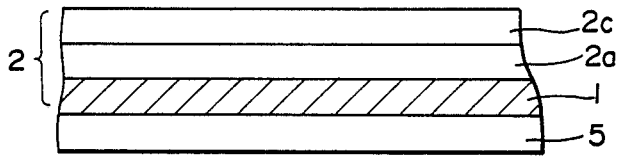
FIGS. 1A-1 to 1A-3 are schematic illustrations of cross-sectional views of examples of a first embodiment of a thermosensitive recording material according to the present invention.

A thermosensitive recording material according to the present invention comprises (a) a support, (b) a thermosensitive recording layer formed on one side (the display side or front) of the support, which thermosensitive recording layer comprises (i) a thermosensitive coloring layer comprising a coloring system capable of forming a color upon application of heat thereto and (ii) a colored layer comprising a colored fluorescent dye composition.

The recording material according to the present invention may additionally includes (c) an adhesive layer formed on the back side of the support opposite the thermosensitive recording layer.

As the support, any support materials that are employed in conventional thermosensitive recording materials can be employed in the present invention. Cellulosic and synthetic papers are most typically used.

The thermosensitive recording layer may be constructed, for example, with any of the following types of structures:

Type 1: A thermosensitive recording layer comprising (i) a thermosensitive coloring layer comprising a thermosensitive coloring system and (ii) a colored layer comprising a colored fluorescent dye composition, which are successively overlaid on the support. When the thermosensitive recording of the above type is employed in the thermosensitive recording material, a barrier layer can be formed at least on the colored layer or on the back side of the support opposite the thermosensitive coloring layer, or between the thermosensitive coloring layer and the colored layer.

Type 2: A thermosensitive recording layer comprising (i) a colored layer comprising a colored fluorescent dye composition and (ii) a thermosensitive coloring layer comprising a thermosensitive coloring system, which are successively overlaid on the support. When the thermosensitive recording of the above type is employed in the thermosensitive recording material, a barrier layer can be formed at least on the thermosensitive coloring layer or on the back side of the support opposite the thermosensitive coloring layer, or between the thermosensitive coloring layer and the colored layer.

Type 3: A thermosensitive recording layer comprising (i) a thermosensitive coloring layer comprising a thermosensitive coloring system and a colored fluorescent dye composition and (ii) a colored layer comprising a fluorescent dye composition, which are successively overlaid on the support. When the thermosensitive recording of the above type is employed in the thermosensitive recording material, a barrier layer can be formed at least on the colored layer or on the back side of the support opposite the thermosensitive coloring layer, or between the colored layer and the thermosensitive coloring layer.

Type 4: A thermosensitive recording layer comprising (i) a colored layer comprising a colored fluorescent dye composition and (ii) a thermosensitive coloring layer comprising a thermosensitive coloring system and a colored fluorescent dye composition, which are successively overlaid on the support. When the thermosensitive recording of the above type is employed in the thermosensitive recording material, a barrier layer can be formed at least on the thermosensitive coloring layer or on the back side of the support opposite the thermosensitive coloring layer, or between the thermosensitive coloring layer and the colored layer.

In the above, the barrier layer is for protecting the thermosensitive recording layer from adverse materials such as oils and plasticizers which may discolor the images developed in the recording layer. It is preferable that the barrier layer comprise a water-soluble polymeric material such as polyvinyl alcohol, carboxymethylcellulose, methylcellulose, ethylcellulose, hydroxymethylcellulose, hydroxyethylcellulose, hydroxypropylcellulose, polyacrylamide, starch, gelatin, casein and polyvinyl pyrrolidone. In addition, resins dispersed in water, for instance, polystyrene emulsion, can also be employed in the barrier layer.

For making the barrier layer water-proof, the following waterproof agents can be employed: formaldehyde, glyoxal, chromium alum, melamine, melamine-formaldehyde resin, polyamide resin and polyamide-epichlorohydrin resin.

Further, conventionally employed inorganic and organic fillers can be incorporated in the thermosensitive coloring layer, the colored layer, and the barrier layer, particularly in a front barrier layer formed on the thermosensitive recording layer, for improving the thermal head matching properties of the thermosensitive recording material.

In the above thermosensitive coloring layer and the colored layer, the conventional binder agents such as gelatin, starch, hydroxymethylcellulose, hydroxyethylcellulose, polyacrylic acid, carboxymethylcellulose, carboxyethylcellulose, methylcellulose, ethylcellulose, methoxycellulose, polycellulose, polyvinyl alcohol, polyacrylamide, casein and polyvinyl pyrrolidone, and the same binder agents as those employed in the above-mentioned barrier layer can be employed. In addition, the same waterproof agents as those employed in the barrier layer can also be employed in the thermosensitive coloring layer and in the colored layer.

As the thermosensitive coloring system employed in the thermosensitive recording layer, the following systems may be employed in the present invention:

(1) A thermosensitive coloring system comprising a combination of (a) a long-chain fatty acid iron salt such as iron stearate and iron myristate, and (b) a phenolic compound such as tannic acid, gallic acid and ammonium salicylate.
(2) A thermosensitive coloring system comprising a combination of (a) a heavy metal sulfate such as silver sulfate, lead sulfate, mercury sulfate and thorium sulfate, and (b) a sulfur compound such as sodium tetrathionate, sodium thiosulfate and thiourea.
(3) A thermosensitive coloring system comprising a combination of (a) an organic acid noble metal salt such as silver behenate and silver stearate, and (b) an aromatic organic reducing agent such as protocatechuic acid, spiro-indane and hydroquinone.
(4) A thermosensitive coloring system comprising a combination of (a) an organic acid lead salt such as lead caproate, lead pelargonate and lead behenate, and (b) a thiourea derivative such as ethylenethiourea and N-dodecylthiourea.
(5) A thermosensitive coloring system comprising a combination of a leuco dye and a color developer capable of inducing color formation in the leuco dye.

These thermosensitive coloring systems are well known and readily available in this art.

In the above thermosensitive coloring system comprising a combination of a leuco dye and a color developer, specific examples of a leuco dye for use in the present invention are as follows:

3-[N-(p-tolylamino)]-7-anilinofluoran,
3-[N-(p-tolyl)-N-methylamino]-7-anilinofluoran,
3-[N-(p-tolyl)-N-ethylamino]-7-anilinofluoran,
3-[N-(p-tolyl)-N-propylamino]-7-anilinofluoran,
3-dimethylamino-6-methyl-7-anilinofluoran,
3-diethylamino-6-methyl-7-anilinofluoran,
3-dipropylamino-6-methyl-7-anilinofluoran,
3-dibutylamino-6-methyl-7-anilinofluoran,
3-pyrrolidino-6-methyl-7-anilinofluoran,
3-piperidinono-6-methyl-7-anilinofluoran,
3-piperazino-6-methyl-7-anilinofluoran,
3-N-(N'-methylpiperazino)-6-methyl-7-anilinofluoran,
3-morpholino-6-methyl-7-anilinofluoran,
3-dibenzylamino-6-methyl-7-anilinofluoran,
3-(N-methyl-n-cyclohexyl)-6-methyl-7-anilinofluoran, and
3-(N-cyclohexylamino)-6-methyl-7-anilinofluoran.

Specific examples of a color developer for the above leuco dyes that can be employed in the thermosensitive coloring system are as follows:

2,2'-methylenebis(4-ethyl-6-t-butylphenol),
2,2'-methylenebis(4-methyl-6-t-butylphenol),
4,4'-isopropylidenediphenol,
4,4'-isopropylidenebis(2-chlorophenol),
4,4'-isopropylidenebis(2,6-dibromophenol),
4,4'-isopropylidenebis(2,6-dichlorophenol),
4,4'-isopropylidenebis(2-methylphenol),
4,4'-isopropylidenebis(2,6-dimethylphenol),
4,4'-isopropylidenebis(2-t-butylphenol),
4,4'-sec-butylidenediphenol,
4,4-cyclohexylidenediphenol,
4,4-cyclohexylidenbis(2-methylphenol),
2,2'-thiobis(4,6-dichlorophenol) and
4,4'-(1-methyl-n-hexylidene)diphenol.

In addition to the above, a variety of electron accepting materials capable of inducing color formation in the above leuco dyes upon application of heat thereto, for example, phenolic and other organic acidic materials, inorganic acidic materials, esters and salts thereof, can be employed.

Specific examples of such color developers are gallic acid, salicylic acid, 3-isopropyl salicylic acid, 3-cyclohexyl salicylic acid, 3,5-di-tert-butyl salicylic acid, 3,5-di-α-methylbenzyl salicylic acid, 4,4'-cyclohexylidenebisphenol, 4-tert-butylphenol, 4-phenylphenol, 4-hydroxydiphenoxide, α-naphthol, β-naphthol, 3,5-xylenol, thymol, methyl-4-hydroxybenzoate, 4-hydroxyacetophenone, novolak-type phenolic resin, catechol, resorcinol, hydroquinone, pyrogallol, phloroglucine, phlorogluocinocarboxylic acid, 4-tert-octylcatechol, 2,2'-methylenebis(4-chlorophenol), 2,2'-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl p-hydroxybenzoate, zinc salicylate, 1-hydroxy-2-naphthoic acid, 2-hydroxy-6-naphthoic acid, zinc 2-hydroxy-6-naphthoate, 4-hydroxydiphenylsulfone, 4-hydroxy-4'-chlorodiphenylsulfone, bis(4-hydroxyphenyl)sulfide, 2-hydroxy-p-toluic acid, zinc 3,5-di-tert-butylsalicylate, tin 3,5-di-tert-butylsalicyate, tartaric acid, oxalic acid, maleic acid, citric acid, succinic acid, stearic acid, 4-hydroxyphthalic acid, boric acid, 4,4'-methylenebis(oxyethylenethio)diphenol, 4-hydroxy-4'-isopropoxyphenyl sulfone, and 1,5-di(4-hydroxy phenylthio)3-oxapentane.

In the present invention, fluorescent dyes are preferably incorporated in the thermosensitive recording layer as a resin grind, i.e., as a pulverized composition of a fluorescent dye and a resin, which is referred to as the colored fluorescent dye composition.

Specific examples of fluorescent dyes for use in the pulverized fluorescent dye composition are Thioflavine (C.I. 49005), Fluoresein (C.I. 35350), Brilliant sulfoflavine FF (C.I. 56205), Basic Yellow HG (C.I. 46040), Eosine (C.I. 45380), Rhodamine 6G (C.I. 45160) and Rhodamine B (C.I. 45170).

Specific examples of synthetic resins for use in the pulverized fluorescent dye composition are acrylic resin, polyester resin, polyamide resin, polyvinyl chloride resin, alkyd resin, aromatic sulfonamide resin, urea resin, melamine resin, benzoguanamine resin and copolymers thereof.

The pulverized fluorescent dye composition can be prepared by dyeing such a resin with one of the above mentioned fluorescent dyes in the course of preparation of the resin (for instance, in the course of emulsion polymerization to prepare the resin in the presence of such fluorescent dye) or by dissolving such a fluorescent dye in one of the resins to form a solid solution, followed by pulverizing the colored resin.

It is preferable that the average particle size of the pulverized fluorescent dye composition be in the range of from 0.5 μm to 5 μm.

In either the thermosensitive coloring layer or the colored layer, conventionally employed dyes and pigments can be contained when necessary, in addition to the above-mentioned thermosensitive coloring system or the fluorescent dye composition.

As mentioned previously, an adhesive layer may be formed on the back side of the support opposite the thermosensitive recording layer. In such adhesive layer, any conventional adhesive agents can be employed. For example, acrylic adhesive agent, starch adhesive agent and styrene-butadiene latex can be employed. Other pressure-sensitive adhesives as conventionally used in adhesive labels may also be employed herein.

For convenience, a disposable backing sheet such as silicone coated paper may be attached to the adhesive layer when present, which can be peeled off the adhesive layer when the thermosensitive recording material is used.

A first embodiment of a thermosensitive recording material according to the present invention will now be explained with reference to FIG. 1A-1.

In the figure, reference numeral 1 indicates a support, and reference numeral 2, a thermosensitive recording layer formed on the support 1. The thermosensitive recording layer 2 is of the previously mentioned Type 1, which comprises a thermosensitive coloring layer 2a comprising a thermosensitive coloring system and a binder agent, and a colored layer 2c comprising a colored fluorescent dye composition and a binder agent, which is capable of not only serving as a colored layer, but also capable of protecting the thermosensitive coloring layer 2a from adverse materials such as oils and plasticizers. Reference numeral 5 indicates an adhesive layer which is formed on the back side of the support 1 opposite the thermosensitive recording layer 2.

Figures 1, 1A, 2:
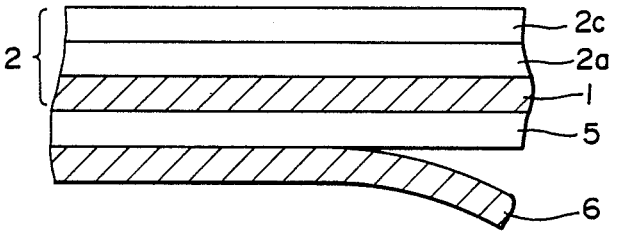

A disposable backing sheet 6 may be attached to the adhesive layer 5 as shown in FIG. 1A-2. Further, a release layer 7, made of, for example, silicone resin, can be formed on the colored layer 2c as shown in FIG. 1A-3.

In this embodiment, the colored fluorescent dye composition is not contained in the thermosensitive coloring layer 2a, but in the colored layer 2c.

Examples of a binder agent that can be employed in the thermosensitive coloring layer 2a are gelatin, starch, hydroxyethylcellulose, polyacrylic acid, carboxyethylcellulose, methoxycellulose, polyvinyl alcohol and polyvinyl pyrrolidone. These can also be employed in the colored layer 2c.

In the colored layer 2c, it is preferable that the amount of the colored fluorescent dye composition be in the range of 10 to 95 wt.%, more preferably in the range of 40 to 80 wt.%, to the entire weight of the colored layer 2c.

In order to improve the thermal head matching properties of the thermosensitive coloring layer 2a, it is preferable that conventionally employed inorganic and organic fillers be employed in either the colored layer 2c or the thermosensitive coloring layer 2a, or in both of them.

By referring to the following example, the first embodiment of the present invention will now be explained in more detail.

Example 1A

[Preparation of Coloring Liquid (Liquid A) and Color Developer Liquid (Liquid B)]

The following Liquid A and Liquid B were prepared by grinding the respective components in a ceramic ball mill for 24 hours:

| | Parts by Weight |
|---|---|
| Liquid A | |
| 3-(N-ethyl-N-p-tolyl)amino-6-methyl-7-anilinofluoran | 150 |
| 5% aqueous solution of polyvinyl alcohol | 150 |
| Water | 200 |

-continued

| | Parts by Weight |
|---|---|
| Liquid B | |
| Bisphenol A | 120 |
| Stearamide | 120 |
| 5% aqueous solution of polyvinyl alcohol | 120 |
| Water | 200 |

[Preparation of Thermosensitive Coloring Layer coating Composition]

100 parts by weight of Liquid A and 400 parts by weight of Liquid B were mixed and dispersed, whereby a thermosensitive coloring layer coating composition was prepared.

The thus prepared thermosensitive coloring layer coating composition was coated on a sheet of commercially available high quality paper (having a basis weight of 52 g/m$^2$) with a coating weight of 5 g/m$^2$ when dried, so that a thermosensitive coloring layer 2a was formed on the high quality paper.

[Preparation of Colored Layer Coating Composition (Liquid C)]

A mixture of the following components was dispersed in a ceramic ball mill, whereby a colored layer coating composition (Liquid C) was prepared:

| Liquid C | Part by Weight |
|---|---|
| Carboxyl-group-modified polyvinyl alcohol | 50 |
| Urea - formaldehyde resin filler | 10 |
| Polyamide epichlorohydrin resin | 5 |
| Water | 500 |
| 50% aqueous dispersion of pulverized fluorescent dye composition (solid solution of Rhodamine Dye and acrylic resin) | 10 |

The thus prepared colored layer coating composition (Liquid C) was coated on the thermosensitive coloring layer 2a with a coat weight of 7 g/m$^2$ when dried, whereby a colored layer 2c was formed on the thermosensitive coloring layer 2a. Thereafter, the colored layer 2c was subjected to calendering to make the surface of the colored layer 2c smooth.

An acrylic adhesive agent was applied to the back side of the support, so that an adhesive layer 5 was formed.

A silicone-resin-coated disposable backing sheet 6 was attached to the above formed adhesive layer 5 as shown in FIG. 1A-2, whereby a thermosensitive recording adhesive label No. 1A according to the present invention was prepared.

By a commercially available thermal printer with a thermal head built therein, thermal printing was performed on the thermosensitive recording adhesive label No. 2A-2. As a result, clear black images were formed on the adhesive label with a fluorescent orange background having a remarkable recognition effect.

Figures 1, 1A, 2, 3:
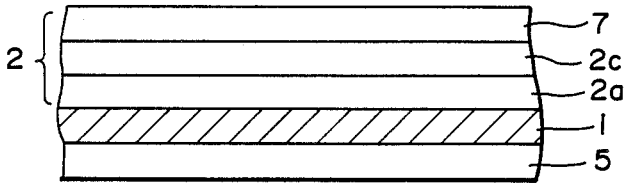
Figures 1, 1B:
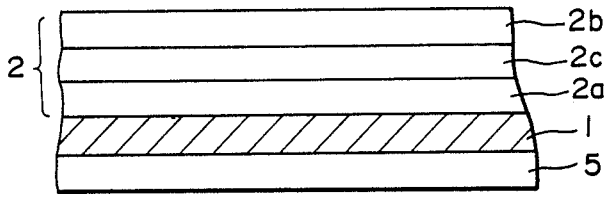
Figures 1, 1B, 2:
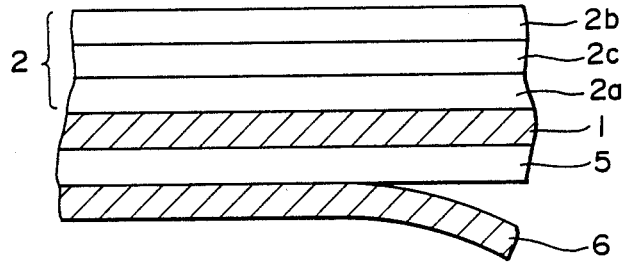
Figures 1, 1B, 2, 3:
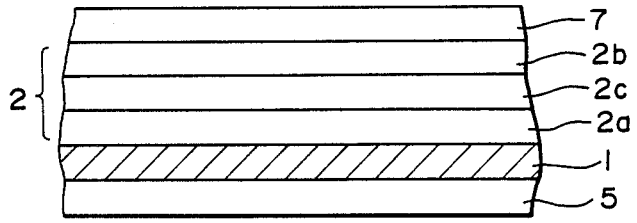

FIG. 1B-1 shows another variation of the first embodiment of a thermosensitive recording material according to the present invention.

In the figure, reference numeral 1 indicates a support, and reference numeral 2, a thermosensitive recording layer formed on the support 1. The thermosensitive recording layer 2 is of the previously mentioned Type 1, which comprises a thermosensitive coloring layer 2a comprising a thermosensitive coloring system and a binder agent, and a colored layer 2c consisting essentially of a colored fluorescent dye composition and a binder agent.

A barrier layer 2b consisting essentially of a resin for protecting the thermosensitive coloring layer 2a from adverse materials such as oils and plasticizers is formed on the thermosensitive coloring layer 2a. The barrier layer 2b may be the same as the front barrier layer 3 employed in the first embodiment of the present invention.

Conventionally employed inorganic and organic fillers can also be added to the barrier layer 2b to improve the thermal head matching properties thereof.

Reference numeral 5 indicates an adhesive layer which is formed on the back side of the support 1 opposite the thermosensitive recording layer 2.

A disposable backing sheet 6 may be attached to the adhesive layer 5 as shown in FIG. 1B-2. Further, a release layer 7, made of, for example, silicone resin, can be formed on the barrier layer 2b as shown in FIG. 1B-3.

The colored layer 2c may be the same as that employed in the previously mentioned second embodiment of the present invention.

Further it is preferable that the deposition amount of the colored layer 2c be in the range of 2 to 8 g/m$^2$, more preferably in the rang of 3 to 6 g/m$^2$.

In order to improve the thermal head matching properties of the thermosensitive recording layer 2, it is preferable that conventionally employed inorganic and organic fillers be employed in either the thermosensitive coloring layer 2a or the barrier layer 2b, or in both of them.

The adhesive layer 5 may be the same as that employed in the previously mentioned first embodiment of the present invention.

By referring to the following example, the above variation of this first embodiment of the present invention will now be explained in more detail.

Example 1B

[Preparation of Coloring Liquid (Liquid A) and Color Developer Liquid (Liquid B)]

Liquid A and Liquid B were prepared in the same manner as in Example 1A.

[Preparation of Thermosensitive Coloring Layer Coating Composition]

100 parts by weight of Liquid A and 400 parts by weight of Liquid B were mixed and dispersed, whereby a thermosensitive coloring layer coating composition was prepared.

The thus prepared thermosensitive coloring layer coating composition was coated on a sheet of commercially available high quality paper (having a basis weight of 52 g/m$^2$) with a coating weight of 10 g/m$^2$ when dried, so that a thermosensitive coloring layer was formed on the high quality paper.

[Preparation of Colored Layer Coating Composition (Liquid D)]

A mixture of the following components was dispersed in a ceramic ball mill, whereby a colored layer coating composition containing a colored fluorescent dye composition (Liquid D) was prepared.

| Liquid D | Parts by Weight |
|---|---|
| 50% aqueous dispersion of pulverized fluorescent dye composition (solid solution of Rhodamine Dye and acrylic resin) | 300 |
| 10% aqueous solution of polyvinyl alcohol | 50 |

The thus prepared colored layer coating composition (Liquid D) was coated on the thermosensitive coloring layer with a coat weight of 5 g/m$^2$ when dried, whereby a colored layer was formed on the thermosensitive coloring layer.

[Preparation of Barrier Layer Coating Composition (Liquid E)]

A mixture of the following components was dispersed in a ceramic ball mill, whereby a barrier layer coating composition (Liquid E) was prepared.

| Liquid E | Part by Weight |
|---|---|
| Carboxyl-group-modified polyvinyl alcohol | 50 |
| Urea - formaldehyde resin filler | 10 |
| Polyamide epichlorohydrin resin | 5 |
| Water | 500 |

The thus prepared barrier layer coating composition (Liquid E) was coated on the colored layer with a coat weight of 3 g/m$^2$ when dried, whereby a barrier layer was formed on the colored layer. Thereafter, the barrier layer was subjected to calendering to make the surface of the barrier layer smooth.

An acrylic adhesive agent was applied to the back side of the support, so that an adhesive layer was formed.

A silicone-resin-coated disposable backing sheet was attached to the above formed adhesive layer, whereby a thermosensitive recording adhesive label No. 2B according to the present invention was prepared.

By a commercially available thermal printer with a thermal head built therein, thermal printing was performed on the thermosensitive recording adhesive label No. 2B. As a result, clear black images were formed on the adhesive label with a fluorescent orange background having a remarkable recognition effect.

A further variation of the first embodiment of a thermosensitive recording material according to the present invention will now be explained with reference to FIG. 1C-1.

In the figure, reference numeral 1 indicates a support, and reference numeral 2, a thermosensitive recording layer formed on the support 1. The thermosensitive recording layer 2 is of the previously mentioned Type 1, which comprises a thermosensitive coloring layer 2a comprising a thermosensitive coloring system and a binder agent, and a colored layer 2c consisting essentially of a colored fluorescent dye composition and a binder agent, between which a barrier layer 2b is interposed which consists essentially of a resin for protecting the thermosensitive coloring layer 2a from adverse materials such as oils and plasticizers. The barrier layer 2b may be the same as that employed in the first embodiment of the present invention shown in FIG. 1B-1.

Reference numeral 5 indicates an adhesive layer which is formed on the back side of the support 1 opposite the thermosensitive recording layer 2.

Figures 1, 1C:
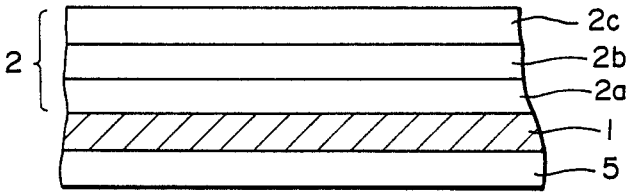
Figures 1, 1C, 2:
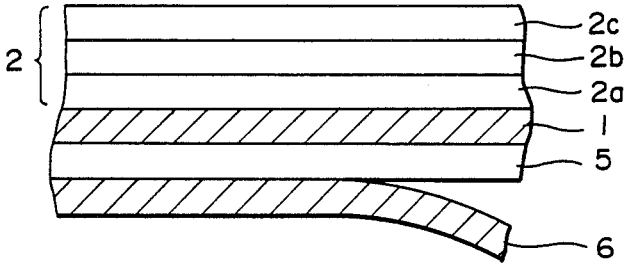
Figures 1, 1C, 2, 3:
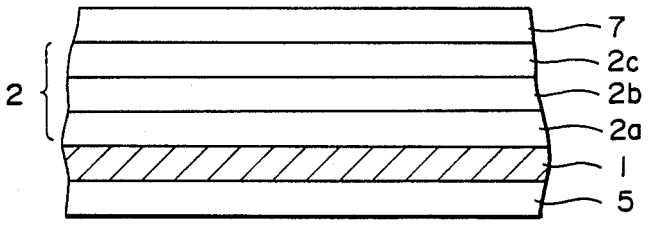
Figures 1, 2:
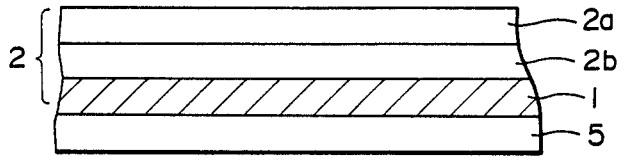
Figure 2:
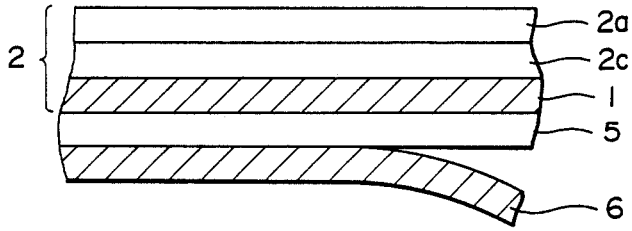
Figures 2, 3:
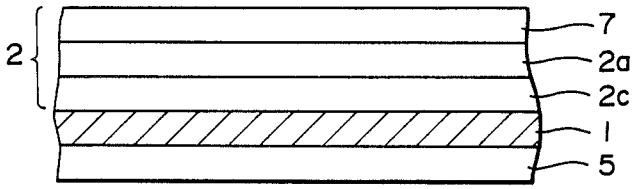

A disposable backing sheet 6 may be attached to the adhesive layer 5 as shown in FIG. 1C-2. Further, a release layer 7, made of, for example, silicone resin, can be formed on the colored layer 2c as shown in FIG. 1C-3.

In the colored layer 2c, it is preferable that the amount of the colored fluorescent dye composition be in the range of 10 to 95 wt.%, more preferably in the range of 40 to 80 wt.%, to the entire weight of the colored layer 2c.

In order to improve the thermal head matching properties of the thermosensitive recording layer 2, it is preferable that conventionally employed inorganic and organic fillers be employed in the thermosensitive coloring layer 2a, or in the colored layer 2c, or in both of them.

The adhesive layer 5 employed in the present invention can be made of an acrylic adhesive agent, a starch adhesive agent, a styrene-butadiene latex or any of these adhesive agents which are microcapsuled.

By referring to the following example, the first embodiment of the present invention will now be explained in more detail.

Example 1C

[Preparation of Coloring Liquid (Liquid A) and Color Developer Liquid (Liquid B)]

Liquid A and Liquid B were prepared in the same manner as in Example 1A.

[Preparation of Thermosensitive Coloring Layer Coating Composition]

100 parts by weight of Liquid A and 400 parts by weight of Liquid B were mixed and dispersed, whereby a thermosensitive coloring layer 2a coating composition was prepared.

The thus prepared thermosensitive coloring layer coating composition was coated on a sheet of commercially available high quality paper (having a basis weight of 52 g/m$^2$) with a coating weight of 10 g/m$^2$ when dried, so that a thermosensitive coloring layer 2a was formed on the high quality paper.

[Preparation of Barrier Layer Coating Composition (Liquid F)]

A mixture of the following components was dispersed in a ceramic ball mill, whereby a barrier layer coating composition (Liquid F) was prepared.

| Liquid F | Part by Weight |
|---|---|
| Carboxyl-group-modified polyvinyl alcohol | 50 |
| Urea - formaldehyde resin filler | 10 |
| Polyamide epichlorohydrin resin | 5 |
| Water | 500 |

The thus prepared barrier layer coating composition (Liquid F) was coated on the thermosensitive coloring layer with a coat weight of 3 g/m$^2$ when dried, whereby a barrier layer 2b was formed on the thermosensitive coloring layer 2a.

[Preparation of Colored Layer Coating Composition (Liquid G)]

A mixture of the following components was dispersed in a ceramic ball mill, whereby a colored layer coating composition containing a colored fluorescent dye composition (Liquid J) was prepared, which is the same as Liquid D employed as the colored layer coating composition in Example 1B:

| Liquid G | Parts by Weight |
|---|---|
| 50% aqueous dispersion of pulverized fluorescent dye Composition (solid solution of Rhodamine Dye and acrylic resin) | 300 |
| 10% aqueous solution of polyvinyl alcohol | 50 |

The thus prepared colored layer coating composition (Liquid G) was coated on the barrier layer 2b with a coat weight of 3 g/m$^2$ when dried, whereby a colored layer 2c was formed on the barrier layer 2b. Thereafter, the colored layer 2c was subjected to calendering to make the surface of the colored layer smooth.

An acrylic adhesive agent was applied to the back side of the support, so that an adhesive layer 5 was formed.

A silicone-resin-coated disposable backing sheet 6 was attached to the above formed adhesive layer 5, whereby a thermosensitive recording adhesive label No. 1C according to the present invention was prepared.

By a commercially available thermal printer with a thermal head built therein, thermal printing was performed on the thermosensitive recording adhesive label No. 1C. As a result, clear black images were formed on the adhesive label with a fluorescent orange background having a remarkable recognition effect.

A second embodiment of a thermosensitive recording material according to the present invention will now be explained with reference to FIG. 2-1.

In the figure, reference numeral 1 indicates a support, and reference numeral 2, a thermosensitive recording layer formed on the support 1. The thermosensitive recording layer 2 is of the previously mentioned Type 3, which comprises a colored layer 2c consisting essentially of a colored fluorescent dye composition and a binder agent and a thermosensitive coloring layer 2a comprising a thermosensitive coloring system and a binder agent.

Reference numeral 5 indicates an adhesive layer which is formed on the back side of the support 1 opposite the thermosensitive recording layer 2.

A disposable backing sheet 6 may be attached to the adhesive layer 5 as shown in FIG. 2-2. Further, a release layer 7, made of, for example, silicone resin, can be formed on the colored layer 2c as shown in FIG. 2-3.

In the colored layer 2c, it is preferable that the amount of the colored fluorescent dye composition be in the range of 10 to 95 wt.%, more preferably in the range of 40 to 80 wt.%, to the entire weight of the colored layer 2c.

In order to improve the thermal head matching properties of the thermosensitive recording layer 2, it is preferable that conventionally employed inorganic and organic fillers be employed in the thermosensitive coloring layer 2a, or in the colored layer 2c, or in both of them.

By referring to the following example, the third embodiment of the present invention will now be explained in more detail.

Example 2

[Preparation of Colored Layer Coating Composition (Liquid C)]

A mixture of the following components was dispersed in a ceramic ball mill, whereby a colored layer coating composition (Liquid C) was prepared, which is the same color layer coating composition as that employed in Example 1A.

| Liquid C | Part by Weight |
|---|---|
| Carboxyl-group-modified polyvinyl alcohol | 50 |
| Urea - formaldehyde resin filler | 10 |
| Polyamide epichlorohydrin resin | 5 |
| Water | 500 |
| 50% aqueous dispersion of pulverized fluorescent dye composition (solid solution of Rhodamine Dye and acrylic resin) | 10 |

The thus prepared colored layer coating composition (Liquid C) was coated on a sheet of commercially available high quality paper having a basis weight of 52 g/m$^2$) with a coating weight of 7 g/m$^2$ when dried, so that a colored layer 2c was formed on the high quality paper.

[Preparation of Coloring Liquid (Liquid A) and Color Developer Liquid (Liquid B)]

Liquid A and Liquid B were prepared in the same manner as in Example 1A.

[Preparation of Thermosensitive Coloring Layer Coating Composition]

100 parts by weight of Liquid A and 400 parts by weight of Liquid B were mixed and dispersed, whereby a thermosensitive coloring layer coating composition was prepared.

The thus prepared thermosensitive coloring layer coating composition was coated on the colored layer with a coating weight of 10 g/m$^2$ when dried, so that a thermosensitive coloring layer 2a was formed on the colored layer 2c.

Thereafter, the thermosensitive coloring layer 2a was subjected to calendering to make the surface of the thermosensitive coloring layer 2a smooth.

An acrylic adhesive agent was applied to the back side of the support, so that an adhesive layer 5 was formed.

A silicone-resin-coated disposable backing sheet 6 was attached to the above formed adhesive layer 5, whereby a thermosensitive recording adhesive label No. 2 according to the present invention was prepared.

By a commercially available thermal printer with a thermal head built therein, thermal printing was performed on the thermosensitive recording adhesive label No. 2. As a result, clear black images were formed on the adhesive label with a fluorescent orange background having a remarkable recognition effect, although the fluorescent orange background was less intense as compared with the thermosensitive recording adhesive label No. 1A according to the present invention prepared in Example 1A.

A third embodiment of a thermosensitive recording material according to the present invention will now be explained with reference to FIG. 3-1.

In the figure, reference numeral 1 indicates a support, and reference numeral 2, a thermosensitive recording layer formed on the support 1. The thermosensitive recording layer 2 is of the previously mentioned Type 3, which comprises a thermosensitive coloring layer 2af comprising a thermosensitive coloring system, a binder agent and a colored fluorescent dye composition, and a colored layer 2c comprising a colored fluorescent dye composition and a binder agent.

A barrier layer 2b may be formed on the colored layer 2c as shown in FIG. 3-2. Further, an adhesive layer 5 may be formed on the back side of the support 1 opposite the thermosensitive recording layer 2 as shown in FIG. 3-3.

Figures 1, 3:
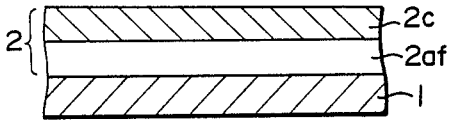
Figures 3, 4:
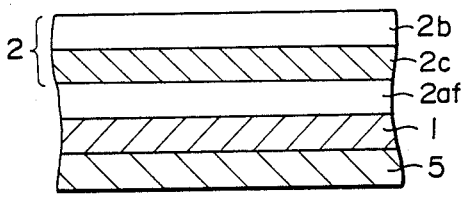
Figures 2, 3:
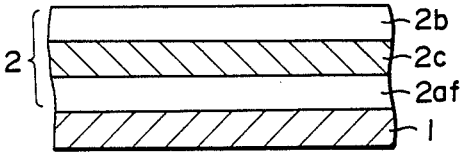

As shown in FIG. 3-4, the barrier layer 2b may be formed on the colored layer 2c and the adhesive layer 5 attached to the back side of the support 1.

Figures 3, 4, 5:
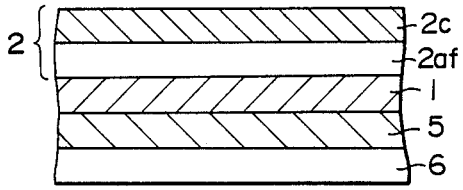
Figure 3:
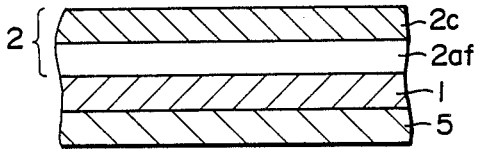
Figures 3, 4, 5, 6:
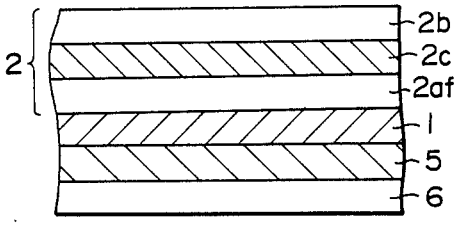

Further as shown in FIG. 3-5, the adhesive layer 5 may be formed on the back side of the support 1, and the disposable backing sheet 6 attached to the adhesive layer 5.

Further as shown in FIG. 3-6, in addition to the adhesive layer 5 and the disposable backing sheet 6 on the support 1 opposite the thermosensitive coloring layer 2af, the barrier layer 2b may be formed on the colored layer 2c.

In these examples of this embodiment of the present invention, an undercoat layer (not shown) consisting essentially of a filler and a binder agent may be interposed between the support 1 and the thermosensitive coloring layer 2af to promote the coloring of the thermosensitive coloring layer 2af.

In this embodiment, a colored fluorescent dye composition is contained not only in the thermosensitive coloring layer 2af, but also in the colored layer 2c, whereby a better recognition effect is attained as compared with the case where a colored fluorescent dye composition is contained only in the thermosensitive coloring layer 2af.

In the thermosensitive coloring layer 2af, it is preferable that the amount of the colored fluorescent dye composition be in the range of 15 to 60 wt.%, more preferably in the range of 35 to 55 wt.%, to the entire weight of the thermosensitive coloring layer 2af.

In the colored layer 2c, it is preferable that the amount of the fluorescent dye composition be in the range of 10 to 95 wt.%, more preferably in the range of 40 to 80 wt.%, to the entire weight of the colored layer 2c.

In order to improve the thermal head matching properties of the thermosensitive recording layer 2, it is preferable that conventionally employed inorganic and organic fillers be employed in the colored layer 2c, or in the thermosensitive coloring layer 2a or in both of them.

By referring to the following example, the fifth embodiment of the present invention will now be explained in more detail.

Example 3-1

[Preparation of Coloring Liquid (Liquid A) and Color Developer Liquid (Liquid B)]

Liquid A and Liquid B were prepared in the same manner as in Example 1A.

[Preparation of Dispersion of Fluorescent Dye Composition]

A mixture of the following components was dispersed in a ceramic ball mill until the average particle size of the solid components became 2 μm, whereby a fluorescent dye composition dispersion (Liquid H) was prepared.

| Liquid H | Part by Weight |
|---|---|
| Pulverized fluorescent dye composition (solid solution of Rhodamine Dye and melamine condensation resin) | 100 |
| 10% aqueous solution of polyvinyl alcohol | 100 |
| Dispersing agent (dialkyl sodium sulfosuccinate) | 1 |
| Water | 199 |

[Preparation of Thermosensitive Coloring Layer Coating Composition]

100 parts by weight of Liquid A, 400 parts by weight of Liquid B and 150 parts by weight of Liquid H were mixed and dispersed, whereby a thermosensitive coloring layer coating composition was prepared.

The thus prepared thermosensitive coloring layer coating composition was coated on a sheet of commercially available high quality paper (having a basis weight of 52 g/m$^2$) with a coating weight of 10 g/m$^2$ when dried, so that a thermosensitive coloring layer *2af* was formed on the high quality paper.

[Preparation of Colored Layer Coating Composition (Liquid H)]

The above Liquid H was employed as a colored layer coating composition.

This colored layer coating composition was coated on the thermosensitive coloring layer *2af* with a coat weight of 1.5 g/m$^2$ when dried, whereby a colored layer was formed on the thermosensitive coloring layer *2af*.

[Preparation of Barrier Layer Coating Composition (Liquid E)]

A mixture of the following components was dispersed in a ceramic ball mill, whereby a barrier layer coating composition (Liquid E) was prepared, which was the same as that employed in Example 1B:

| Liquid E | Part by Weight |
|---|---|
| Carboxyl-group-modified polyvinyl alcohol | 50 |
| Urea - formaldehyde resin filler | 10 |
| Polyamide epichlorohydrin resin | 5 |
| Water | 500 |

The thus prepared barrier layer coating composition (Liquid E) was coated on the colored layer *2c* with a coat weight of .3 g/m$^2$ when dried, whereby a barrier layer *2b* was formed on the colored layer *2c*.

An acrylic adhesive agent was applied to the back side of the support 1, so that an adhesive layer 5 was formed.

A silicone-resin-coated disposable backing sheet 6 was attached to the above formed adhesive layer 5, whereby a thermosensitive recording adhesive label No. 3-1 according to the present invention was prepared.

By a commercially available thermal printer with a thermal head built therein, thermal printing was performed on the thermosensitive recording adhesive label No. 3-1. As a result, clear black images were formed on the adhesive label with a fluorescent orange background having a remarkable recognition effect.

Example 3-2

Example 3-1 was repeated except that Liquid H which was employed in Example 3-1 was replaced by 300 parts by weight of a 50% aqueous dispersion of a pulverized fluorescent dye composition (solid solution of Rhodamine Dye and acrylic resin) having an average particle size of 1.8 μm (Liquid I), whereby a thermosensitive recording adhesive label No. 3-2 according to the present invention was prepared.

By a commercially available thermal printer with a thermal head built therein, thermal printing was performed on the thermosensitive recording adhesive label No. 3-2. As a result, clear black images were formed on the adhesive label with a fluorescent orange background having a remarkable recognition effect.

Example 3-3

Example 3-2 was repeated except that the colored layer coating composition (Liquid I) in Example 3-2 was replaced by the following dispersion (Liquid J) which was prepared by dispersing the following components in a ceramic ball mill until the average particle size of the solid components become 20 μm, whereby a thermosensitive recording adhesive label No. 3-3 according to the present invention was prepared:

| Liquid J | Part by Weight |
|---|---|
| Pulverized fluorescent dye composition (solid solution of Rhodamine Dye and acylic resin) | 100 |
| Calcium carbonate | 100 |
| 10% aqueous solution of polyvinyl alcohol | 150 |
| Water | 150 |

By a commercially available thermal printer with a thermal head built therein, thermal printing was performed on the thermosensitive recording adhesive label No. 3-3. As a result, clear black images were formed on the adhesive label with a fluorescent orange background having a remarkable recognition effect.

A thermosensitive recording material having a thermosensitive recording layer of the previously mentioned Type 4 can be prepared in the same manner except by reversing overlaying order of the thermosensitive coloring layer *2af* and the colored layer *2c*, and clear black images with a fluorescent orange background can be also obtained with a remarkable recognition effect.

What is claimed is:

1. A thermosensitive recording material comprising:

a support; and a thermosensitive recording layer formed on one side of said support, said thermosensitive recording layer comprising (i) thermosensitive coloring layer comprising a thermosensitive coloring system capable of producing a colored image upon application of heat thereto, and (ii) a colored layer comprising a colored fluorescent dye composition and a first resin, said colored fluorescent dye composition comprising a second resin which is dyed with a fluorescent dye or in which a fluorescent dye is dissolved, wherein said colored layer forms a fluorescent colored background for said image.

2. The thermosensitive recording material as claimed in claim 1, wherein said colored layer is overlaid on said thermosensitive coloring layer in said thermosensitive recording layer.

3. The thermosensitive recording material as claimed in claim 2, further comprising a barrier layer on said colored layer.

4. The thermosensitive recording material as claimed in claim 2, further comprising a barrier layer between said thermosensitive coloring layer and said colored layer.

5. The thermosensitive recording material as claimed in claim 1, wherein said thermosensitive coloring layer is overlaid on said colored layer.

6. The thermosensitive recording material as claimed in claim 5, further comprising a barrier layer on said thermosensitive coloring layer.

7. The thermosensitive recording material as claimed in claim 5, further comprising a barrier layer between said thermosensitive coloring layer and said colored layer.

8. The thermosensitive recording material as claimed in claim 1, wherein said thermosensitive coloring system is a combination of a leuco dye and a color developer capable of inducing color formation in said leuco dye upon application of heat thereto.

9. The thermosensitive recording material as claimed in claim 1, wherein the amount of said colored fluorescent dye composition in said colored layer is in the range of 10 to 95 wt.% of the entire weight of said colored layer.

10. A thermosensitive recording material comprising:

a support, and a thermosensitive recording layer formed on one side of said support, said thermosensitive recording layer comprising (i) a thermosensitive coloring layer comprising a coloring system capable of producing a colored image upon application of heat thereto and a colored fluorescent dye composition, and (ii) a colored layer comprising a colored fluorescent dye composition and a first resin, said colored fluorescent dye composition comprising a second resin which is dyed with a fluorescent dye or in which a fluorescent dye is dissolved, wherein said colored layer forms a fluorescent colored background for said image.

11. The thermosensitive recording material as claimed in claim 10, wherein the amount of said colored fluorescent dye composition in said thermosensitive coloring layer is in the range of 15 to 60 wt.% of the entire weight of said thermosensitive coloring layer.

12. A thermosensitive recording material comprising:

a support, and a thermosensitive recording layer formed on one side of said support, said thermosensitive recording layer comprising (i) a thermosensitive coloring layer comprising a thermosensitive color system capable of producing a colored image upon application of heat thereto and a binder resin, and (ii) a colored layer comprising a colored fluorescent dye composition and a first resin, said colored fluorescent dye comprising a second resin which is dyed with a fluorescent dye or in which a fluorescent dye is dissolved, wherein said colored layer forms a fluorescent colored background for said image.

13. The thermosensitive recording material as claimed in claim 12, wherein said colored layer is overlaid on said thermosensitive coloring layer in said thermosensitive recording layer.

14. The thermosensitive recording material as claimed in claim 12, wherein said thermosensitive coloring layer is overlaid on said colored layer.

15. The thermosensitive recording material as claimed in claim 12, further comprising a barrier layer between said thermosensitive coloring layer and said colored layer.

16. The thermosensitive recording material as claimed in claim 12, further comprising a barrier layer provided on the side of said support opposite said thermosensitive recording layer.

17. The thermosensitive recording material as claimed in claim 12, further comprising a barrier layer provided on said thermosensitive recording layer.

18. The thermosensitive recording material as claimed in claim 12, wherein said thermosensitive coloring layer further comprises a fluorescent dye composition.

19. The thermosensitive recording material as claimed in claim 18, wherein the amount of said colored fluorescent dye composition in said thermosensitive coloring layer is in the range of 15 to 60 wt.% of the entire weight of said thermosensitive coloring layer.

20. The thermosensitive recording material as claimed in claim 12, wherein the amount of said colored fluorescent dye composition in said colored layer is in the range of 10 to 95 wt.% of the entire weight of said colored layer.

21. A thermosensitive recording material comprising:

a support; and a thermosensitive recording layer formed on one side of said support, said thermosensitive recording layer comprising (i) a thermosensitive coloring layer comprising a thermosensitive color system capable of producing a color upon application of heat thereto, and (ii) a colored layer comprising a colored fluorescent dye composition, wherein said thermosensitive coloring layer is overlaid on said colored layer.

22. The thermosensitive recording material as claimed in claim 21, further comrpising a barrier layer on said thermosensitive coloring layer.

23. A thermosensitive recording material as claimed in claim 21, further comprising a barrier layer between said thermosensitive coloring layer and said colored layer.

24. A thermosensitive recording material comprising:

a support, and a thermosensitive recording layer formed on one side of said support, said thermosensitive recording layer comprising (i) a thermosensitive coloring layer comprising a thermosensitive coloring system capable of producing a color upon application of heat thereto and a binder resin, and (ii) a colored layer comprising a colored fluorescent dye composition and a binder resin, wherein said thermosensitive coloring layer is overlaid on said colored layer.

25. A thermosensitive recording material comprising:

a support, and a thermosensitive recording layer formed on one side of said support, said thermosensitive recording layer comprising (i) a thermosensitive coloring layer comprising a thermosensitive coloring system capable of producing a color image upon application of heat thereto and (ii) a colored layer comprising a colored fluorescent dye composition, wherein said colored layer forms a fluorescent colored background for said image.

26. A thermosensitive recording material comprising:
a support, and
a thermosensitive recording layer formed on one side of said support, said thermosensitive recording layer comprising (i) a thermosensitive coloring layer comprising a coloring system capable of producing a colored image upon application of heat thereto and a colored fluorescent dye composition, and (ii) a colored layer comprising a colored fluorescent dye composition, wherein said colored layer forms a fluorescent colored background for said image.

27. A thermosensitive recording material comprising:
a support, and
a thermosensitive recording layer formed on one side of said support, said thermosensitive recording layer comprising (i) a thermosensitive coloring layer comprising a thermosensitive coloring system capable of producing a colored image upon application of heat thereto and a binder resin, and (ii) a colored layer comprising a colored fluorescent dye composition, wherein said colored layer forms a fluorescent colored background for said image.

* * * * *

UNITED STATES PATENT AND TRADEMARK OFFICE

CERTIFICATE OF CORRECTION

PATENT NO. : 4,950,638

DATED : August 21, 1990

INVENTOR(S) : Yukihiro YUYAMA et al

It is certified that error appears in the above-identified patent and that said Letters Patent is hereby corrected as shown below:

In Column 16, line 32, "and acylic resin)" should read

-- and acrylic resin) --.

In Column 18, line 20, "in Claim 18" should read

-- in Claim 12 --.

Signed and Sealed this

Sixth Day of April, 1993

*Attest:*

STEPHEN G. KUNIN

*Attesting Officer*

*Acting Commissioner of Patents and Trademarks*

UNITED STATES PATENT AND TRADEMARK OFFICE

CERTIFICATE OF CORRECTION

PATENT NO. : 4,950,638

DATED : August 21, 1990

INVENTOR(S) : Yuyamam, et al

It is certified that error appears in the above-indentified patent and that said Letters Patent is hereby corrected as shown below:

Column 17, lines 60-61, "said colored fluorescent dye comprising"; should read --said colored fluorescent dye composition comprising--.

Signed and Sealed this

Twenty-third Day of November, 1993

*Attest:*

Bruce Lehman

BRUCE LEHMAN

*Attesting Officer*

*Commissioner of Patents and Trademarks*